US008183792B2

(12) United States Patent
Lin et al.

(10) Patent No.: US 8,183,792 B2
(45) Date of Patent: May 22, 2012

(54) BACKLIGHT MODULE WITH DYNAMIC OPEN-LAMP PROTECTION AND RELATED DRIVING METHOD

(75) Inventors: Yung-Chun Lin, Taoyuan County (TW); Po-Wen Wang, Taipei County (TW); Chin-Sheng Chueh, Taoyuan (TW); Jiun-Wei Tseng, Changhua County (TW)

(73) Assignee: Qisda Corporation, Taoyuan County (TW)

( * ) Notice: Subject to any disclaimer, the term of this patent is extended or adjusted under 35 U.S.C. 154(b) by 228 days.

(21) Appl. No.: 12/793,688

(22) Filed: Jun. 4, 2010

(65) Prior Publication Data

US 2010/0315005 A1 Dec. 16, 2010

(30) Foreign Application Priority Data

Jun. 12, 2009 (TW) ..... 98119701 A

(51) Int. Cl.
*G05F 1/00* (2006.01)

(52) U.S. Cl. ..... 315/291; 315/247; 315/278; 315/312; 315/307

(58) Field of Classification Search ..... 315/291, 315/224, 225, 247, 246, 185 S, 312–326, 315/307–311
See application file for complete search history.

(56) References Cited

U.S. PATENT DOCUMENTS 7,800,317 B2 * 9/2010 Kimura ..... 315/307
2009/0160355 A1 * 6/2009 Suzuki ..... 315/291
* cited by examiner

*Primary Examiner* — Tuyet Thi Vo

(57) ABSTRACT

In order to provide open-lamp protection to a backlight module, a pseudo open-lamp voltage is first generated according to the current flowing through a light source. If the backlight module receives a mode signal corresponding to a high contrast mode, a compensation voltage is added to the pseudo open-lamp voltage for generating a reference voltage. If the reference voltage is larger than a feedback voltage received from an input node of the light source, a driving voltage is outputted to the light source.

10 Claims, 5 Drawing Sheets

BACKLIGHT MODULE WITH DYNAMIC OPEN-LAMP PROTECTION AND RELATED DRIVING METHOD

BACKGROUND OF THE INVENTION

1. Field of the Invention

The present invention is related to a backlight module and related driving method, and more particularly, to a backlight module with dynamic open-lamp protection and related driving method.

2. Description of the Prior Art

Liquid crystal display (LCD) devices, characterized in thin appearance, low power consumption and no radiation, have been widely used in various electronic products, such as computer systems, mobile phones, and personal digital assistants (PDAs). In a prior art LCD device, brightness/contrast adjustment is performed by controlling the driving voltage/current of a light source in a backlight module of the LCD device. The contrast ratio of the LCD device can be largely improved (such as from 500:1 to 50000:1) using dynamic contrast ratio (DCR) technique. DCR technique can be implemented using an image processing system which automatically detects the image brightness of the input signal and dynamically adjusts the brightness of the backlight module accordingly. Therefore, DCR technique can reduce light leakage when displaying dark images, and can increase the contrast between bright and dark images.

Reference is made to FIG. 1 for a functional diagram of a prior art backlight module 100 with static open-lamp protection. The backlight module 100 includes a light source 150, a transformer 110 for driving the light source 150, an inverter controller 120, and an open-lamp protection circuit 130. The light source 150 may include lamps $LAMP_1$-$LAMP_N$ coupled in parallel, and the input end of the light source 150 is coupled to the transformer 110 for receiving the driving voltage. The voltage established at the input end of the light source 150 is represented by a feedback voltage $V_{FB}$, and the brightness of the lamps $LAMP_1$-$LAMP_N$ is related to lamp currents $I_{L1}$-$I_{LN}$, respectively. The open-lamp protection circuit 130, coupled to the output end of the light source 150, is configured to provide a pseudo open circuit voltage $V_{OP}$ according to the lamp currents $I_{L1}$-$I_{LN}$. The inverter controller 120, having a first input end coupled to the input end of the light source 150 and a second input end coupled to the open-lamp protection circuit 130, is configured to provide a power control signal $S_{CT}$ by comparing the voltage levels of the feedback voltage $V_{FB}$ and the pseudo open circuit voltage $V_{OP}$. The transformer 110 can thus adjust the driving voltage according to the power control signal $S_{CT}$. When the lamps of the light source 150 function normally and the display device 1 operates under medium/low contrast mode, the feedback voltage $V_{FB}$ (such as 0.9V) is smaller than the pseudo open circuit voltage $V_{OP}$ (such as 1.5V). At this time, the inverter controller 120 outputs the power control signal $S_{CT}$ to the transformer 110 and the inverter controller 120 outputs the driving voltage for driving the light source 150. When an open-lamp defect (open circuit) occurs in the lamps of the light source 150, the feedback voltage $V_{FB}$ becomes larger than the pseudo open circuit voltage $V_{OP}$. At this time, the inverter controller 120 stops outputting the power control signal $S_{CT}$ for turning off the transformer 110, thereby turning off the backlight module 100. When DCR function (high contrast mode) of the display device 1 is activated, the lamp currents $I_{L1}$-$I_{LN}$, the feedback voltage $V_{FB}$ of the light source 150 and the pseudo open circuit voltage $V_{OP}$ of the open-lamp protection circuit 130 need to be lowered in order to provide more brightness options. For example, when the feedback voltage $V_{FB}$ drops below 0.7V and the pseudo open circuit voltage $V_{OP}$ drops below 0.2V, it is determined that an open-lamp defect occurs in the light source 150. The transformer 110 is then inadequately turned off, which in turn influences the operation of the display device 1.

Reference is made to FIG. 2 for a functional diagram of a prior art backlight module 200 without open-lamp protection. The backlight module 200 includes a light source 250, a transformer 210 for driving the light source 250, and an inverter controller 220. The light source 250 may include lamps $LAMP_1$-$LAMP_N$ coupled in parallel. The voltage established at the input end of the light source 250 is represented by a feedback voltage $V_{FB}$, and the brightness of the lamps $LAMP_1$-$LAMP_N$ is related to lamp currents $I_{L1}$-$I_{LN}$, respectively. The inverter controller 220 includes a first input end for receiving a constant voltage $V_{CC}$ and a second input end for receiving the feedback voltage $V_{FB}$, thereby generating the power control signal $S_{CT}$ accordingly. The prior art backlight module 200 does not provide open-lamp protection, and the display device 2 can provide multiple brightness options using the small lamp currents $I_{L1}$-$I_{LN}$ without misjudging open-lamp defects. However, if an open-lamp defect occurs in the lamps of the light source 250, the backlight module 200 cannot be turned off and the transformer 210 continues to output high-level voltages, which may cause arcing phenomenon and endanger the safety of the display device 2.

SUMMARY OF THE INVENTION

The present invention provides a backlight module with dynamic open-lamp protection and comprising a light source, a transformer, an open-lamp protection circuit, a dynamic compensation circuit, and an inverter controller. The light source includes an input end and an output end. The transformer is configured to output a driving voltage to the input end of the light source according to a power control signal. The open-lamp protection circuit is coupled to the output end of the light source and configured to provide a pseudo open circuit voltage according to a current flowing through the light source. The dynamic compensation circuit is coupled to the open-lamp protection circuit and configured to provide a reference voltage by compensating the pseudo open circuit voltage according to a mode signal. The inverter controller, coupled to the light source, the dynamic compensation circuit and the transformer, comprises a first input end coupled to the input end of the light source for receiving a feedback voltage; a second input end coupled to the dynamic compensation circuit for receiving the reference voltage; and an output end coupled to the transformer for outputting the power control signal to the transformer when the feedback voltage is smaller than the reference voltage.

The present invention further provides a liquid crystal display device with dynamic open-lamp protection and comprising a signal generator for providing a mode signal and a backlight module for receiving the mode signal. The backlight module comprises alight source, a transformer, an open-lamp protection circuit, a dynamic compensation circuit, and an inverter controller. The light source includes an input end and an output end. The transformer is configured to output a driving voltage to the input end of the light source according to a power control signal. The open-lamp protection circuit is coupled to the output end of the light source and configured to provide a pseudo open circuit voltage according to a current flowing through the light source. The dynamic compensation circuit is coupled to the open-lamp protection circuit and configured to provide a reference voltage by compensating the pseudo open circuit voltage according to a mode signal. The inverter controller, coupled to the light source, the dynamic compensation circuit and the transformer, comprises a first input end coupled to the input end of the light source for receiving a feedback voltage; a second input end coupled to the dynamic compensation circuit for receiving the reference voltage; and an output end coupled to the transformer for outputting the power control signal to the transformer when the feedback voltage is smaller than the reference voltage.

The present invention further provides method for providing dynamic open-lamp protection when driving a light source in a backlight module. The method comprises generating a pseudo open circuit voltage according to a current flowing through the light source; generating a reference voltage by adding a compensation voltage to the pseudo open circuit voltage when receiving a mode signal which corresponds to a high contrast mode; and outputting a driving voltage to the light source when the reference voltage is larger than a feedback voltage received from an input end of the light source.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
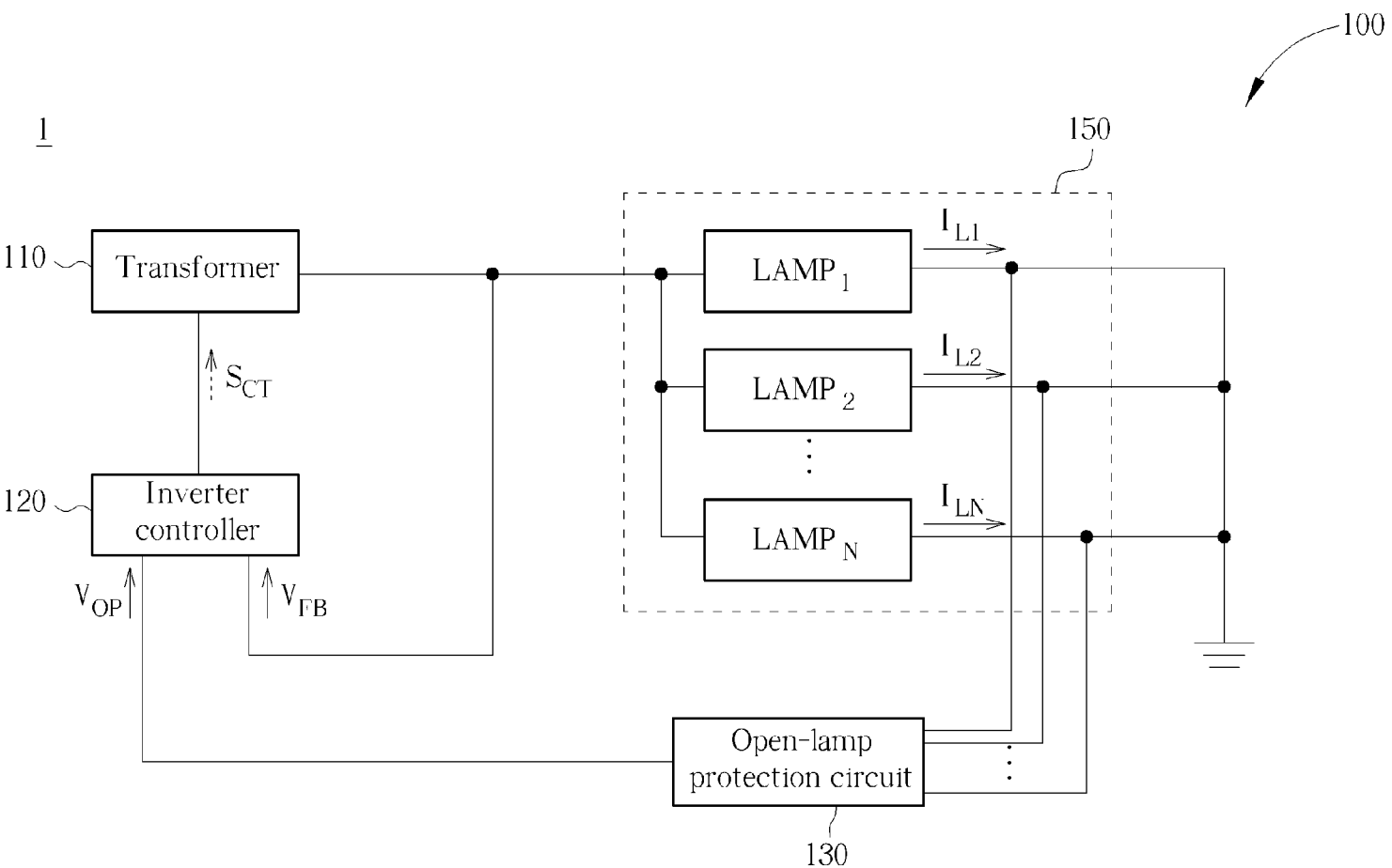
FIG. 1 PRIOR ART
FIG. 1 is a functional diagram of a prior art backlight module with static open-lamp protection.
Figure 2:
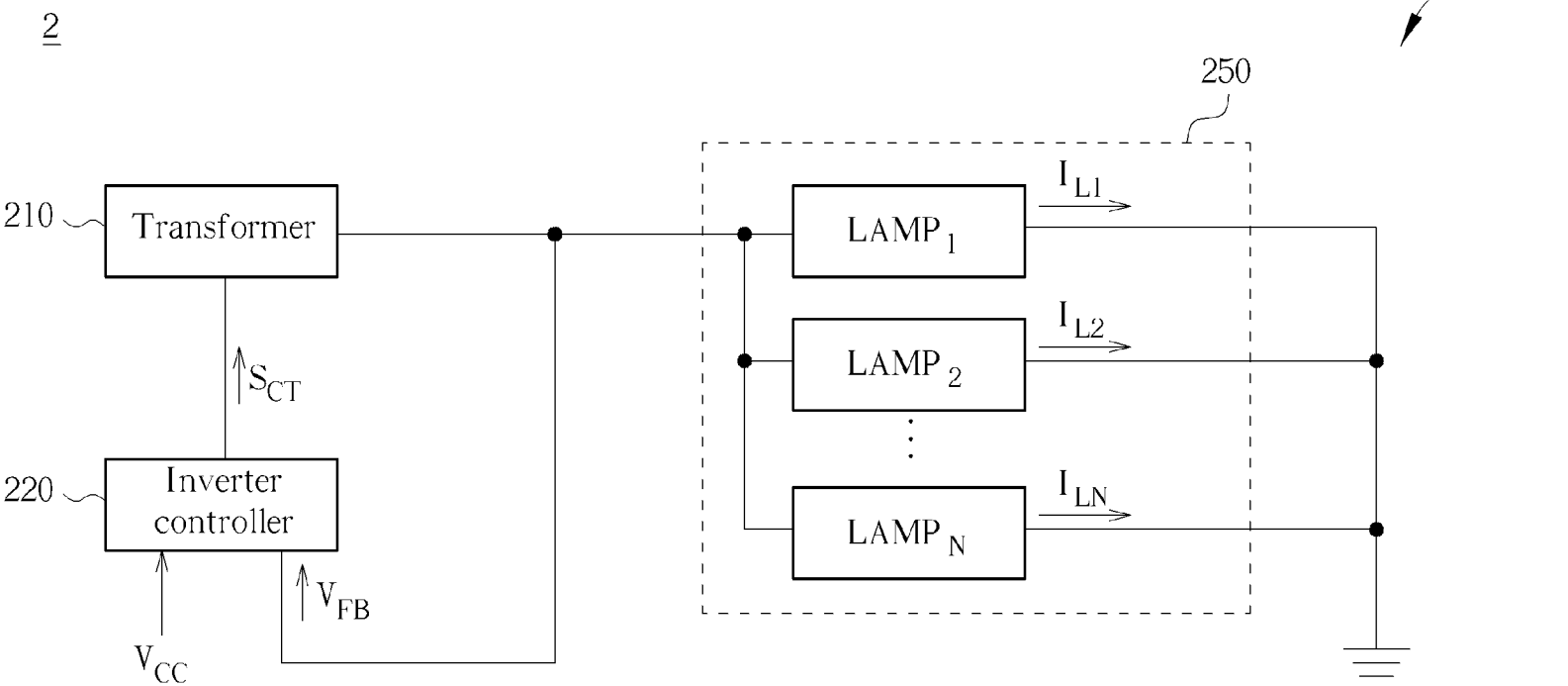
FIG. 2 PRIOR ART
FIG. 2 is a functional diagram of a prior art backlight module without open-lamp protection.
Figure 3:
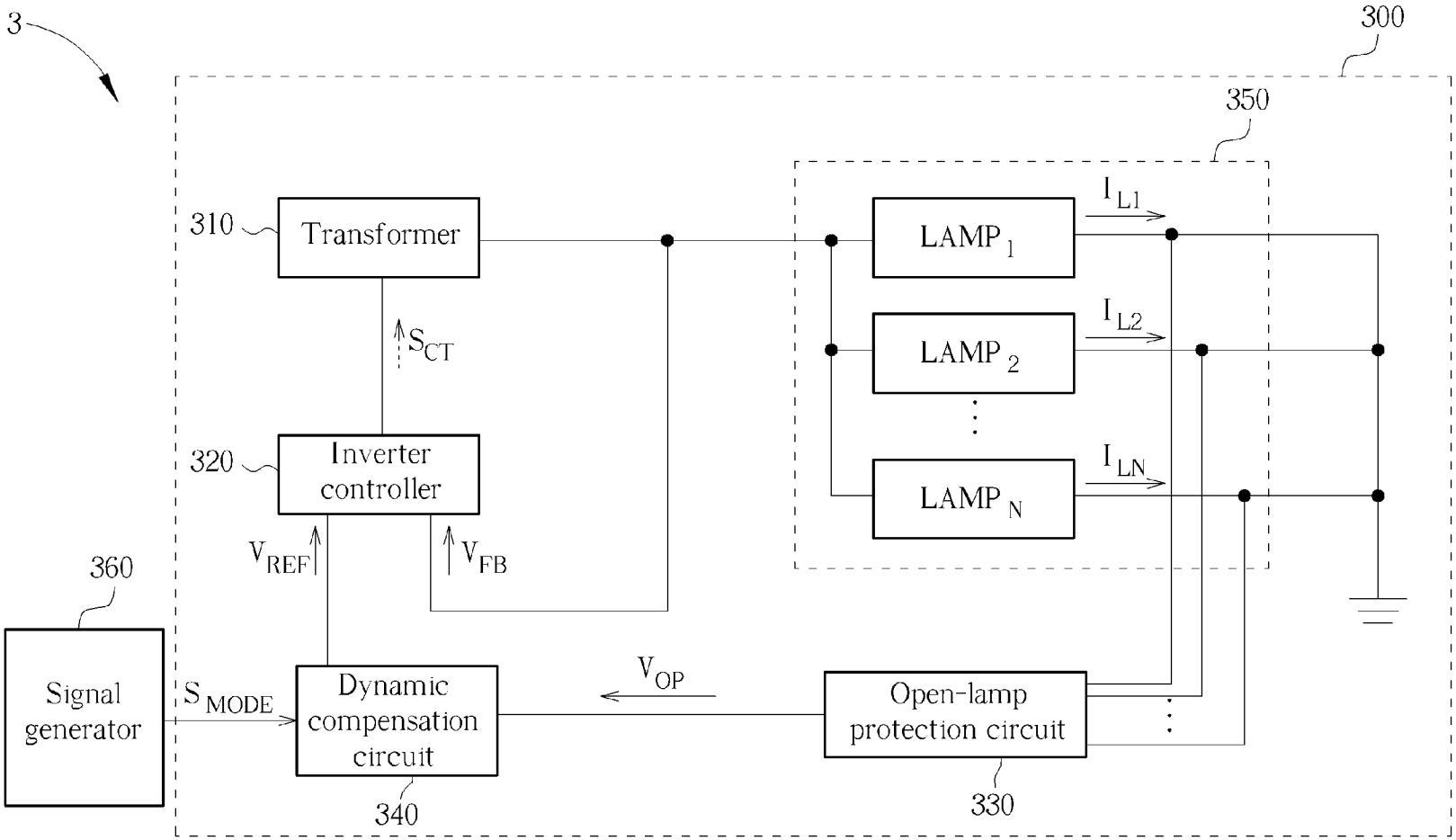
FIG. 3 is a functional diagram of an LCD device according to the present invention.

Reference is made to FIG. 3 for a functional diagram of an LCD device 3 according to the present invention. The LCD device 3 includes a backlight module 300 with dynamic open-lamp protection and a signal generator 360. The backlight module 300 includes a light source 350, a transformer 310 for driving the light source 350, an inverter controller 320, an open-lamp protection circuit 330, and a dynamic compensation circuit 340. The light source 350 may include lamps $LAMP_1$-$LAMP_N$ coupled in parallel. The voltage established at the input end of the light source 350 is represented by a feedback voltage $V_{FB}$, and the brightness of the lamps $LAMP_1$-$LAMP_N$ is related to lamp currents $I_{L1}$-$I_{LN}$, respectively. The open-lamp protection circuit 330, coupled to the output end of the light source 350, is configured to provide a pseudo open circuit voltage $V_{OP}$ according to the lamp currents $I_{L1}$-$I_{LN}$. The dynamic compensation circuit 340 is configured to output a reference voltage $V_{REF}$ according to the pseudo open circuit voltage $V_{OP}$ and a mode signal $S_{MODE}$ outputted by the signal generator 360. When the mode signal $S_{MODE}$ is at high level for activating high contrast mode, the dynamic compensation circuit 340 provides a compensation voltage $\Delta V$, thereby providing the reference voltage $V_{REF}$ equal to the sum of the pseudo open circuit voltage $V_{OP}$ and the compensation voltage $\Delta V$ ($V_{OP}+\Delta V$); when the mode signal $S_{MODE}$ is at low level for activating medium/low contrast mode, no compensation is made to the pseudo open circuit voltage $V_{OP}$, and the pseudo open circuit voltage $V_{OP}$ is directly outputted as the reference voltage $V_{REF}$. The dynamic compensation circuit 340 of the present invention can provide the compensation voltage $\Delta V$ using voltage-dividing resistors coupled in series, or other circuits. The inverter controller 320, having a first input end coupled to the input end of the light source 350 and a second input end coupled to the dynamic compensation circuit 340, is configured to provide a power control signal $S_{CT}$ by comparing the voltage levels of the feedback voltage $V_{FB}$ and the reference voltage $V_{REF}$.

When the display device 3 operates under medium/low contrast mode, the mode signal $S_{MODE}$ is at low level, and the feedback voltage $V_{FB}$, which is equal to the pseudo open circuit voltage $V_{OP}$, is larger than the feedback voltage $V_{FB}$. At this time, the transformer 310 continues to output the driving voltage. When an open-lamp defect occurs in the lamps of the light source 350, the reference voltage $V_{REF}$ becomes smaller than the feedback voltage $V_{FB}$. At this time, the transformer 310 stops outputting the driving voltage, thereby turning off the backlight module 300.

On the other hand, when the LCD device 3 enters high contrast mode, the feedback voltage $V_{FB}$ slightly drops. Even if all lamps in the light source 350 function normally, the pseudo open circuit voltage $V_{OP}$ may have a very small value due to small lamp currents $I_{L1}$-$I_{LN}$. In order to avoid possible misjudgment in open-lamp defects, the present invention provides the compensation voltage $\Delta V$ for increasing the reference voltage $V_{REF}$ to a higher value of ($V_{OP}+\Delta V$). For example, assume that the feedback voltage $V_{FB}$ drops from 0.9V to 0.7V and the pseudo open circuit voltage $V_{OP}$ drops from 1.5V to 0.2V when the LCD device 3 switches from medium/low contrast mode to high contrast mode. In order to avoid possible misjudgment in open-lamp defects, the dynamic compensation circuit 340 is required to provide a compensation voltage $\Delta V$ larger than 0.5V, so that the reference voltage $V_{REF}$ is larger than the feedback voltage $V_{FB}$, the inverter controller 320 outputs the power control signal $S_{CT}$ to the transformer 310, and the transformer 310 continues to output the driving voltage for driving the light source 350.

Figure 4:
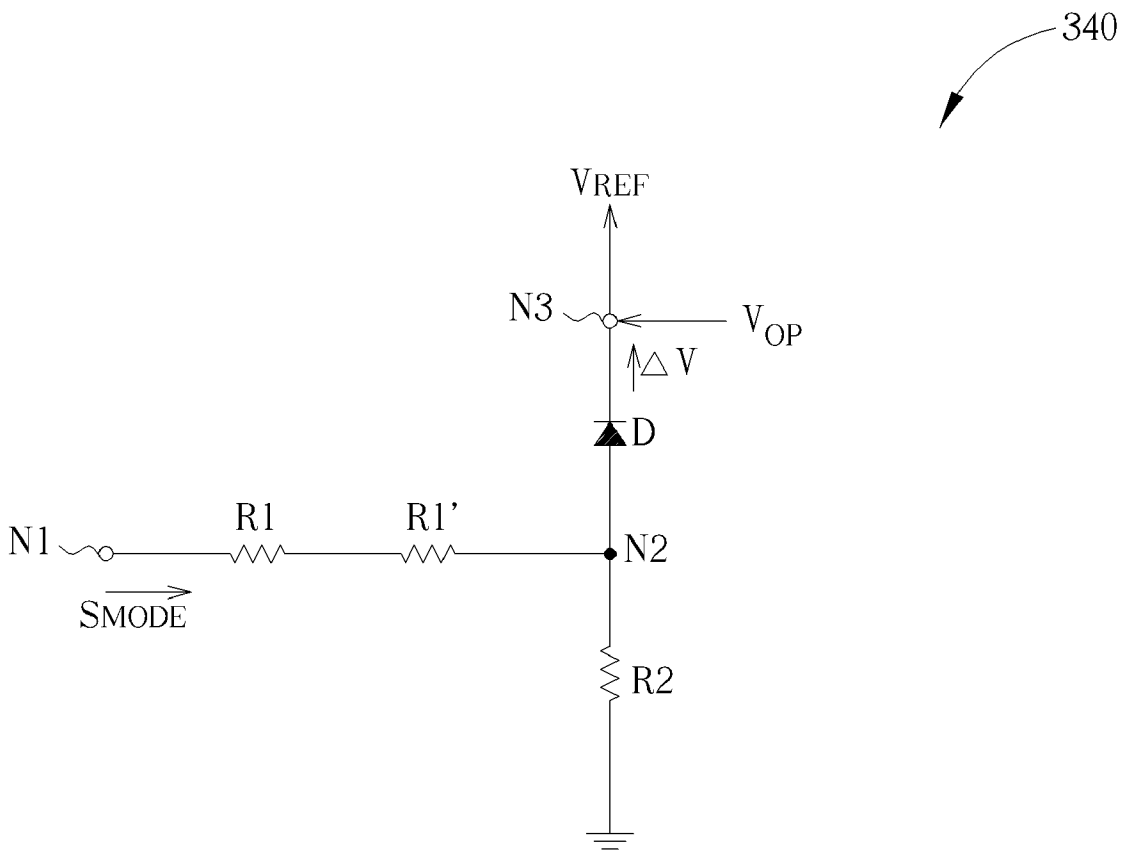
FIG. 4 is a diagram illustrating a dynamic compensation circuit according to an embodiment of the present invention.

Reference is made to FIG. 4 for a diagram illustrating the dynamic compensation circuit 340 according to an embodiment of the present invention. The dynamic compensation circuit 340 in FIG. 4 includes nodes N1-N3, a diode D, and resistors R1-R3. The dynamic compensation circuit 340 receives the mode signal $S_{MODE}$ at the node N1, while receives the pseudo open circuit voltage $V_{OP}$ and outputs the reference voltage $V_{REF}$ at the node N3. When the LCD device 3 operates under medium/low contrast mode, the mode signal $S_{MODE}$ is at low level and the voltage difference established between the nodes N2 and N3 is insufficient to conduct the diode D. The reverse-biased diode is substantially open-circuited, and the reference voltage $V_{REF}$ is equal to the pseudo open circuit voltage $V_{OP}$ ($\Delta V=0$); when the LCD device 3 operates under high contrast mode, the mode signal $S_{MODE}$ is at high level and the voltage difference established between the nodes N2 and N3 is sufficient to conduct the diode D. The forward-biased diode can provide the compensation voltage $\Delta V$, and the reference voltage $V_{REF}$ is equal to the sum of the pseudo open circuit voltage $V_{OP}$ and the compensation voltage $\Delta V$. The dynamic compensation circuit 340 depicted in FIG. 4 is for illustrative purpose and does not limit the scope of the present invention.

Figure 5:
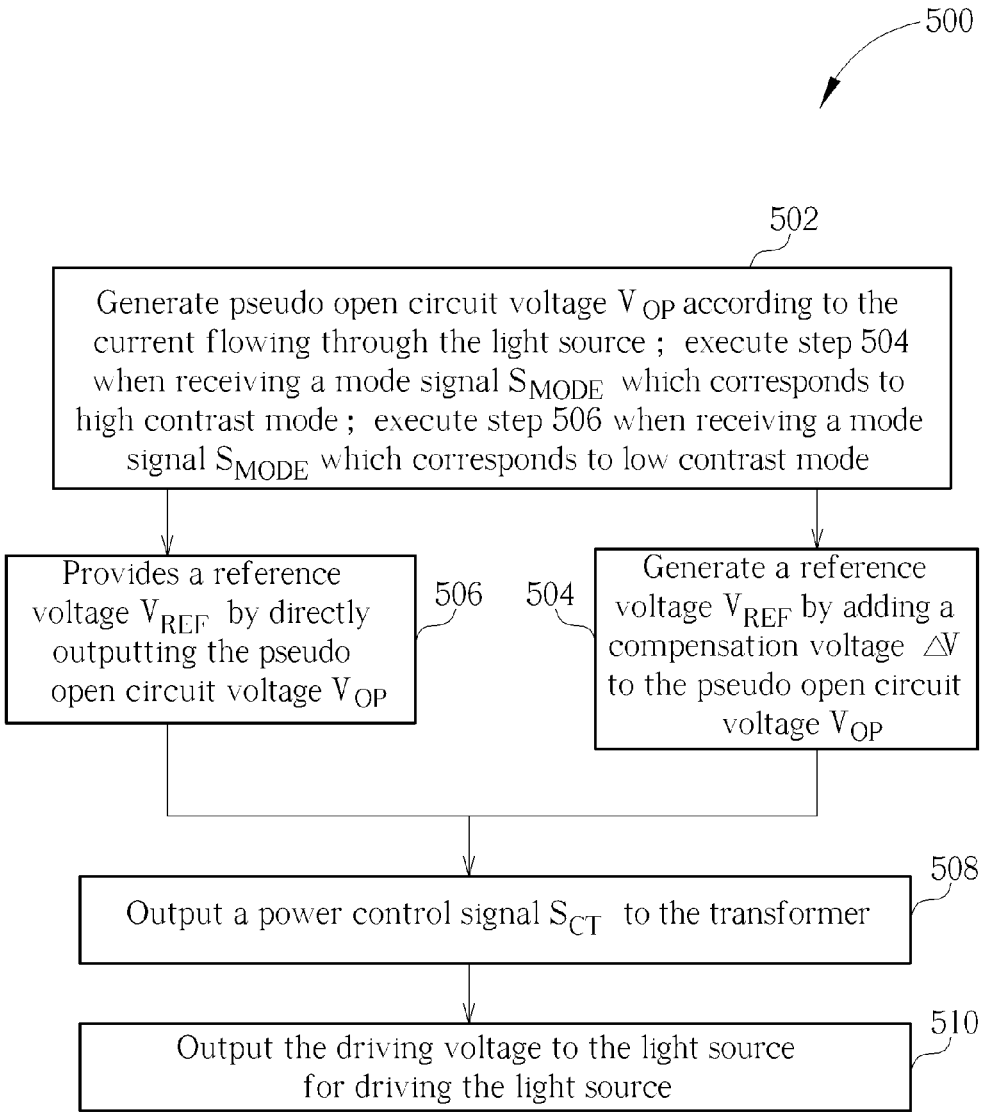
FIG. 5 is a method which provides dynamic open-lamp protection according to an embodiment of the present invention.

Reference is made to FIG. 5 for a method 500 which provides dynamic open-lamp protection when driving a light source in a backlight module. The method 500 includes the following steps:

Step 502: the open-lamp protection circuit 330 generates a pseudo open circuit voltage $V_{OP}$ according to the current flowing through the light source 350; execute step 504 when receiving a mode signal $S_{MODE}$ which corresponds to high contrast mode; execute step 506 when receiving a mode signal $S_{MODE}$ which corresponds to low contrast mode;

Step 504: the dynamic compensation circuit 340 generates a reference voltage $V_{REF}$ by adding a compensation voltage $\Delta V$ to the pseudo open circuit voltage $V_{OP}$; execute step 508;

Step 506: the dynamic compensation circuit 340 provides a reference voltage $V_{REF}$ by directly outputting the pseudo open circuit voltage $V_{OP}$; execute step 508;

Step 508: the inverter controller 320 outputs a power control signal $S_{CT}$ to the transformer 310 when the reference voltage $V_{REF}$ is larger than the feedback voltage $V_{FB}$;

Step 510: the transformer 310 outputs the driving voltage to the light source 350 for driving the light source 350 when receiving the power control signal $S_{CT}$.

In Step 508 as depicted in the embodiment of FIG. 5, if the reference voltage $V_{REF}$ is larger than the feedback voltage $V_{FB}$ due to an open-lamp defect, the inverter controller 320 does not output the power control signal $S_{CT}$ to the transformer 310. In Step 510, the transformer 310 does not output the driving voltage to the light source 350 for driving the light source 350 when not receiving the power control signal $S_{CT}$, thereby capable of protecting the light source 350 from damage.

In conclusion, when the display device 3 operates under high contrast mode, the lamp currents $I_{L1}$-$I_{LN}$ are lowered in order to provide more brightness options. In order to prevent the transformer 310 from being inadequately turned off due to misjudgment in open-lamp defects by the open-lamp protection circuit 330, the present invention provides the compensation voltage $\Delta V$ for increasing the reference voltage $V_{REF}$ to a higher value of ($V_{OP}+\Delta V$). When the display device 3 operates under medium/low contrast mode, the present invention can also provide open-lamp protection. The backlight module 300 can be turned off if an open-lamp defect occurs in the lamps of the light source 350, thereby stopping the transformer 310 from outputting high-level voltages which may cause arcing phenomenon.

Those skilled in the art will readily observe that numerous modifications and alterations of the device and method may be made while retaining the teachings of the invention.

What is claimed is:

1. A backlight module with dynamic open-lamp protection comprising:
- a light source having an input end and an output end;
- a transformer configured to output a driving voltage to the input end of the light source according to a power control signal;
- an open-lamp protection circuit coupled to the output end of the light source and configured to provide a pseudo open circuit voltage according to a current flowing through the light source;
- a dynamic compensation circuit coupled to the open-lamp protection circuit and configured to provide a reference voltage by compensating the pseudo open circuit voltage according to a mode signal; and
- an inverter controller coupled to the light source, the dynamic compensation circuit and the transformer, the inverter controller comprising:
  - a first input end coupled to the input end of the light source for receiving a feedback voltage;
  - a second input end coupled to the dynamic compensation circuit for receiving the reference voltage; and
  - an output end coupled to the transformer for outputting the power control signal to the transformer when the feedback voltage is smaller than the reference voltage.

2. The backlight module of claim 1 wherein the dynamic compensation circuit comprises:
- a first node for receiving the mode signal;
- a second node coupled to a ground;
- a third node for receiving the pseudo open circuit voltage and providing the reference voltage;
- a first resistor coupled between the first node and the second node;
- a second resistor coupled between the second node and the ground; and
- a diode having an anode coupled to the second node and a cathode coupled to the third node.

3. The backlight module of claim 1 wherein the light source comprises a plurality of lamps coupled in parallel.

4. A liquid crystal display (LCD) device with dynamic open-lamp protection comprising:
- a signal generator for providing a mode signal;
- a backlight module for receiving the mode signal and comprising:
  - a light source having an input end and an output end;
  - a transformer configured to output a driving voltage to the input end of the light source according to a power control signal;
  - an open-lamp protection circuit coupled to the output end of the light source and configured to provide a pseudo open circuit voltage according to a current flowing through the light source;
  - a dynamic compensation circuit coupled to the open-lamp protection circuit and configured to provide a reference voltage by compensating the pseudo open circuit voltage according to a mode signal; and
  - an inverter controller coupled to the light source, the dynamic compensation circuit and the transformer, the inverter controller comprising:
  - a first input end coupled to the input end of the light source for receiving a feedback voltage;
  - a second input end coupled to the dynamic compensation circuit for receiving the reference voltage; and
  - an output end coupled to the transformer for outputting the power control signal to the transformer when the feedback voltage is smaller than the reference voltage.

5. The LCD device of claim 4 wherein the dynamic compensation circuit comprises:
- a first node for receiving the mode signal;
- a second node coupled to a ground;
- a third node for receiving the pseudo open circuit voltage and providing the reference voltage;
- a first resistor coupled between the first node and the second node;
- a second resistor coupled between the second node and the ground; and a diode having an anode coupled to the second node and a cathode coupled to the third node.

6. The LCD device of claim 4 wherein the light source comprises a plurality of lamps coupled in parallel.

7. A method for providing dynamic open-lamp protection when driving a light source in a backlight module, the method comprising:

generating a pseudo open circuit voltage according to a current flowing through the light source;

generating a reference voltage by adding a compensation voltage to the pseudo open circuit voltage when receiving a mode signal which corresponds to a high contrast mode; and outputting a driving voltage to the light source when the reference voltage is larger than a feedback voltage received from an input end of the light source.

8. The method of claim 7 further comprising:

providing a power control signal for outputting the pseudo open circuit voltage to the light source when the reference voltage is larger than the feedback voltage.

9. The method of claim 7 further comprising:

providing the reference voltage by directly outputting the pseudo open circuit voltage when receiving the mode signal which corresponds to a low contrast mode.

10. The method of claim 7 wherein the mode signal corresponds to a dynamic contrast ratio (DCR) mode.

* * * * *